US012151154B2

(12) United States Patent
Pupainis et al.

(10) Patent No.: US 12,151,154 B2
(45) Date of Patent: Nov. 26, 2024

(54) SAFETY NET FOR A VERTICAL WIND TUNNEL

(71) Applicant: AERODIUM, SIA, Sigulda (LV)

(72) Inventors: Juris Pupainis, Sigulda (LV); Arnis Rubins, Sigulda (LV); Ivars Beitäns, Sigulda (LV)

( * ) Notice: Subject to any disclaimer, the term of this patent is extended or adjusted under 35 U.S.C. 154(b) by 882 days.

(21) Appl. No.: 17/268,602

(22) PCT Filed: Aug. 16, 2018

(86) PCT No.: PCT/IB2018/056151
§ 371 (c)(1),
(2) Date: Feb. 16, 2021

(87) PCT Pub. No.: WO2020/035717
PCT Pub. Date: Feb. 20, 2020

(65) Prior Publication Data

US 2021/0346778 A1 Nov. 11, 2021

(51) Int. Cl.
*A63G 31/00* (2006.01)
*A63B 71/00* (2006.01)

(52) U.S. Cl.
CPC ..... *A63B 71/0054* (2013.01); *A63G 31/00* (2013.01); *A63B 2071/0063* (2013.01); *A63G 2031/005* (2013.01)

(58) Field of Classification Search
CPC .. A63G 31/00; A63G 33/00; A63G 2031/002; A63G 2031/005
USPC ..... 472/49, 50, 136, 137
See application file for complete search history.

(56) References Cited

U.S. PATENT DOCUMENTS

2020/0324213 A1* 10/2020 Metni ..... G01P 13/00

FOREIGN PATENT DOCUMENTS

WO WO-2016120659 A1 * 8/2016 ..... A63B 5/11

* cited by examiner

*Primary Examiner* — Kien T Nguyen
(74) *Attorney, Agent, or Firm* — Patshegen IP; Moshe Pinchas

(57) ABSTRACT

Invention relates to safety nets for vertical wind tunnels, especially for vertical wind tunnels with glass wall that surrounds a flight platform or area. A safety net for a vertical wind tunnel comprising an annular frame (1) arranged therearound a flight area (2), a plurality of cables (3) forming a net area (4) over the flight area (2), springs (5) attached to the each end of the cables and to the annular frame (1). The springs (5) and each end of plurality of cables (3) is enclosed by the annular frame (1) so that only cables (3) are exposed to the flight area (2) and to a user of the safety net.

5 Claims, 7 Drawing Sheets

SAFETY NET FOR A VERTICAL WIND TUNNEL

FIELD OF THE INVENTION

Invention relates to safety nets for vertical wind tunnels, especially for vertical wind tunnels with glass wall that surrounds a flight platform or area.

BACKGROUND OF THE INVENTION

Typical safety net is illustrated in US patent application No. 2013/0005537A1 disclosing a safety net which includes a frame, a safety net which is hung on the frame by means of springs. From the prior art of sky diving simulators it is known that a base for flying chamber is formed by a safety net. U.S. Pat. No. 7,832,265 discloses a vertical wind tunnel, which levitates a flyer over a rotating fan. A steel mesh net is placed between the fan and the flyer so that the flyer does not fall into the rotating blades of the fan. In the meantime the steel mesh net works also as base surface for flying arena or chamber. The net is connected with framework by means of ropes forming a connection area. Usually safety nets for vertical wind tunnels are similar to leisure trampolines.

Another U.S. Pat. No. 6,083,100 discloses vertical wind tunnel training device cable net and suspension system having springs.

The safety net moves up and down during use of the vertical wind tunnel. Due to this vertical movement of the ropes or cables is limited by other construction elements of the vertical wind tunnel. In any of above described prior art solutions the safety net during its use touches other construction elements of the vertical wind tunnel, makes the net more rigid during a fall and increases a possibility of an injury. During extensive use the cable or ropes of the safety net wear down and should be changed for the new ones. It ads overhead costs and complexity of use of vertical wind tunnel.

There is a need to find new ways to improve a safety net of vertical wind tunnels so that it requires less service. Hence, reducing overhead costs for use of vertical wind tunnel.

SUMMARY OF THE INVENTION

The above mentioned aim is achieved by a design of a safety net for a vertical wind tunnel comprising an annular frame arranged around a flight area where most of the safety net elements are enclosed within the annular frame.

The annular frame extends around the flight area and it has an upper surface, an outer surface and a lower surface forming enclosed space. The upper surface, the outer surface and the lower surface in context of this invention should be considered as covers or plates that cover these surfaces of the annular frame. An inner surface is open and it faces the vertical wind tunnel or channel where a wind flow is vertically fed into the flight area or platform. In another embodiment, the upper, outer and lower surfaces may perform the load bearing role of the spring block, where upper surface has openings for access to springs and safety net. During operation, openings are covered with plates.

The safety net comprises a plurality of cables forming a net area over the flight area. Each end of plurality of cables is attached to the annular frame via springs. The springs are fully enclosed by the annular frame. The cables enter the annular frame through inner surface of the annular frame that is open. The springs and each end of plurality of cables is enclosed by the annular frame so that only cables are exposed to the flight area and a user of the safety net.

The annular frame on the inner surface thereof comprises a slider. The slider extends from the upper surface of the annular frame to the lower surface of the annular frame. The slider is arranged around the inner surface of the annular frame. The slider is not at an entrance point in the vertical wind tunnel where an entrance unit is positioned. The slider comprises guide openings so that the cables may extend through the guide openings and can move along the guide openings up and down, when a user of the vertical wind tunnel walks or falls on the net area. The upper surface and the lower surface of the annular frame are arranged to such a distance, that none of the cables touches these surfaces, when the cables move up and especially down upon influence of a user (walking and/or falling on the net area) of the vertical wind tunnel. Use of slider provides less disturbance of the air flow in the same time allowing free movement of the cables without touching any construction elements of the vertical wind tunnel.

The slider further comprises auxiliary guide openings positioned orthogonally to the guide openings so that the cables that are orthogonally positioned relative to other cables may extend through the slider and the cables can move along the auxiliary guide openings up and down, when a user of the vertical wind tunnel walks or falls on the net area.

The guide opening further comprises a brush that covers the guide opening so that a movement of the cable is kept or allowed, but noise generated by the vertical wind in area of spectators is reduced.

The safety net further comprises an entrance unit arranged in the annular frame in a position where an entrance in the flight area of the vertical wind tunnel is positioned. The entrance unit is part of the annular frame.

The entrance unit comprises an entry platform positioned at the same level as the upper surface of the annular frame. A first end of the entry platform is hingedly attached to the entrance unit and second end of the entry platform is free and extends until the flight area. When a user of the vertical wind tunnel steps onto the entry platform it hingedly moves down.

The entrance unit further comprises a belt or a skirt attached to the second end of the entry platform and the belt or the skirt covers the surface of the annular frame or the entrance unit between safety net and lower surface of annular frame that is exposed to the flight area. Therefore, the entrance unit does not disturb the air flow in the vertical wind tunnel. The entrance unit further comprises a resilient member with one end thereof attached to the belt and with another end thereof attached to the entrance unit so that the belt is kept tensioned, when the entry platform is hingedly moved down, when a user of the vertical wind tunnel walks in or out from the flight area.

In another embodiment, the entrance unit instead of the belt of the skirt comprises at least two plates that cover the surface of the annular frame between the entry platform and the lower surface of the annular frame of the entrance unit. The plates are hingedly attached to each other and to the entry platform from one side and to the lower surface of the annular frame from other side. The hinged attachment is provided by installed hinges. The resilient member from one end is attached to at least one plate, preferably to the hinge between the two plates, and from another end is attached to the entry platform or to the annular frame. When a user of the vertical wind tunnel walks onto the entry platform, the entry platform is hinged downwards in direction towards lower surface of the annular frame. Hingedly attached plates are folded upon the movement of the entry platform and, when a user of the vertical tunnel walks away from the entry platform, the entry platform moves back to its initial position and the plates are moved back to their initial position as well.

DETAILED DESCRIPTION OF THE INVENTION

Before explaining the disclosed embodiment of the present invention in detail, it is to be understood that the invention is not limited in its application to the details of the particular arrangements shown, since the invention is capable of other embodiments. Also, the terminology used herein is for the purpose of description and not of limitation.

Figure 1:
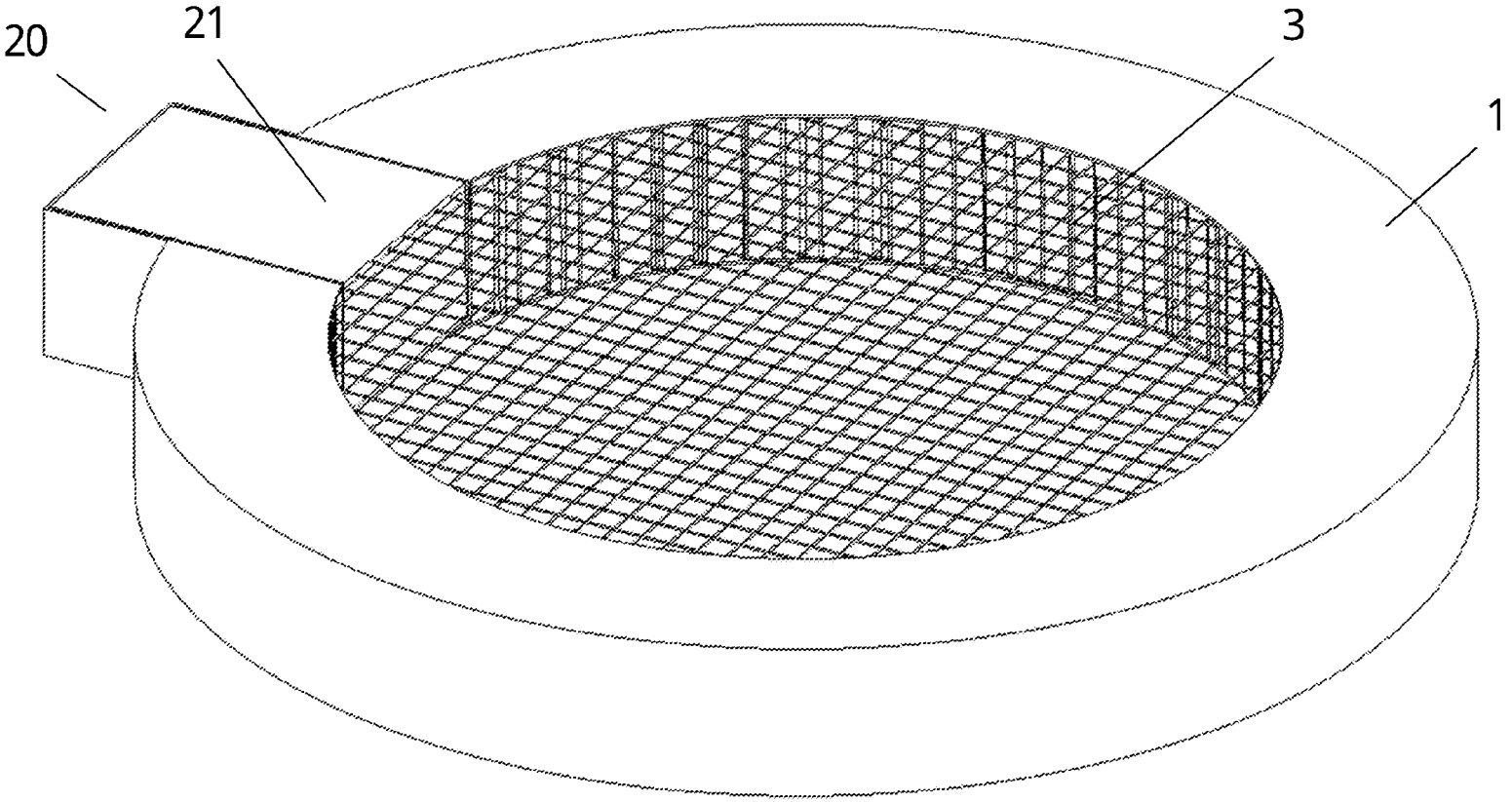
FIG. 1 illustrates a safety net for vertical wind tunnel ready to be installed in vertical wind tunnel that is enclosed by a glass wall.
Figure 2:
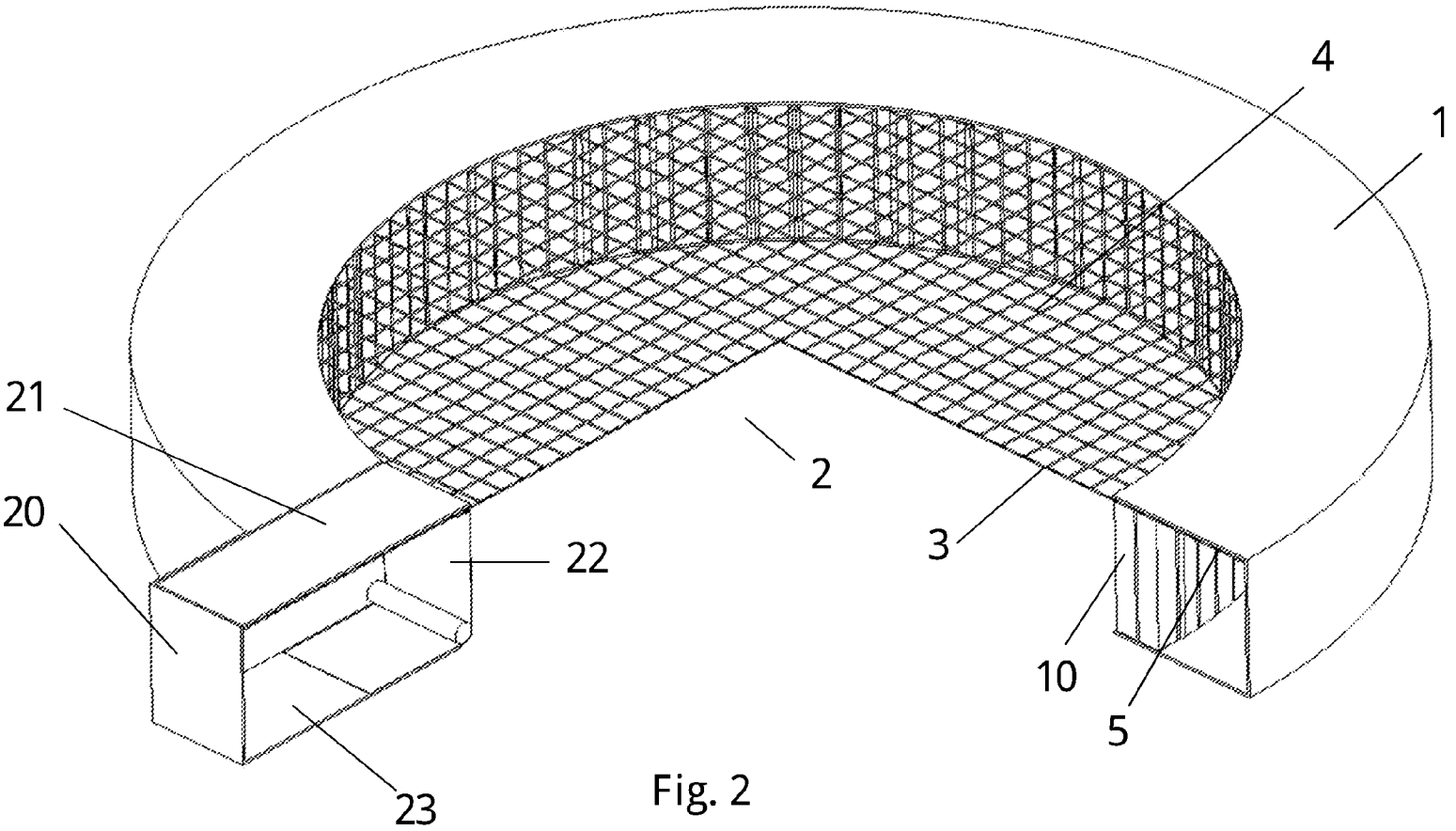
FIG. 2 illustrates a safety net with cut out segment for ease of understanding on how cables 3 are enclosed in an annular frame 1 that surrounds a flight area 2.
Figure 6:
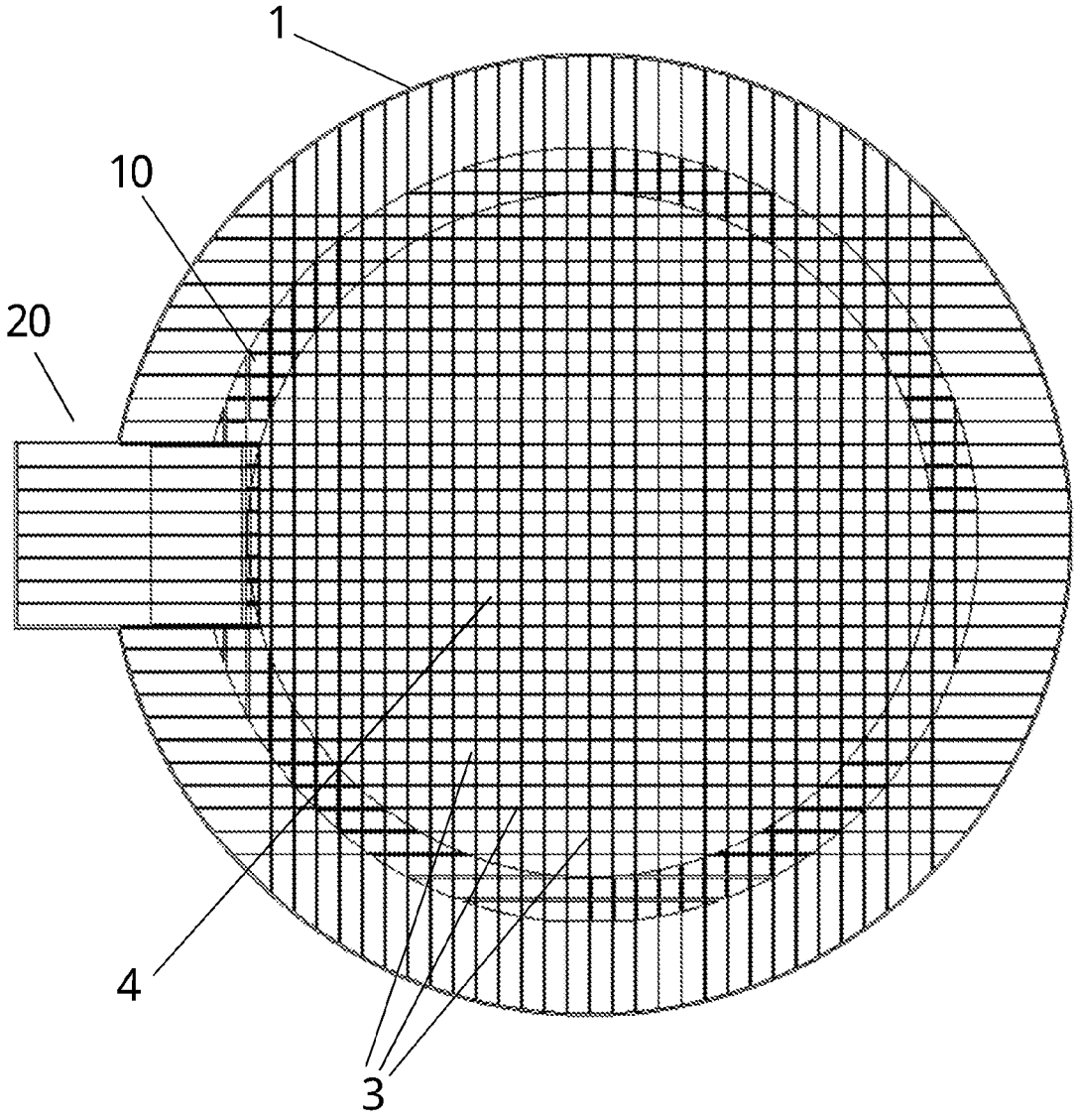
FIG. 6 a top view of a safety net without an upper surface of the annular frame 1 so that a complete arrangement of cables 3 is seen.
Figure 7:
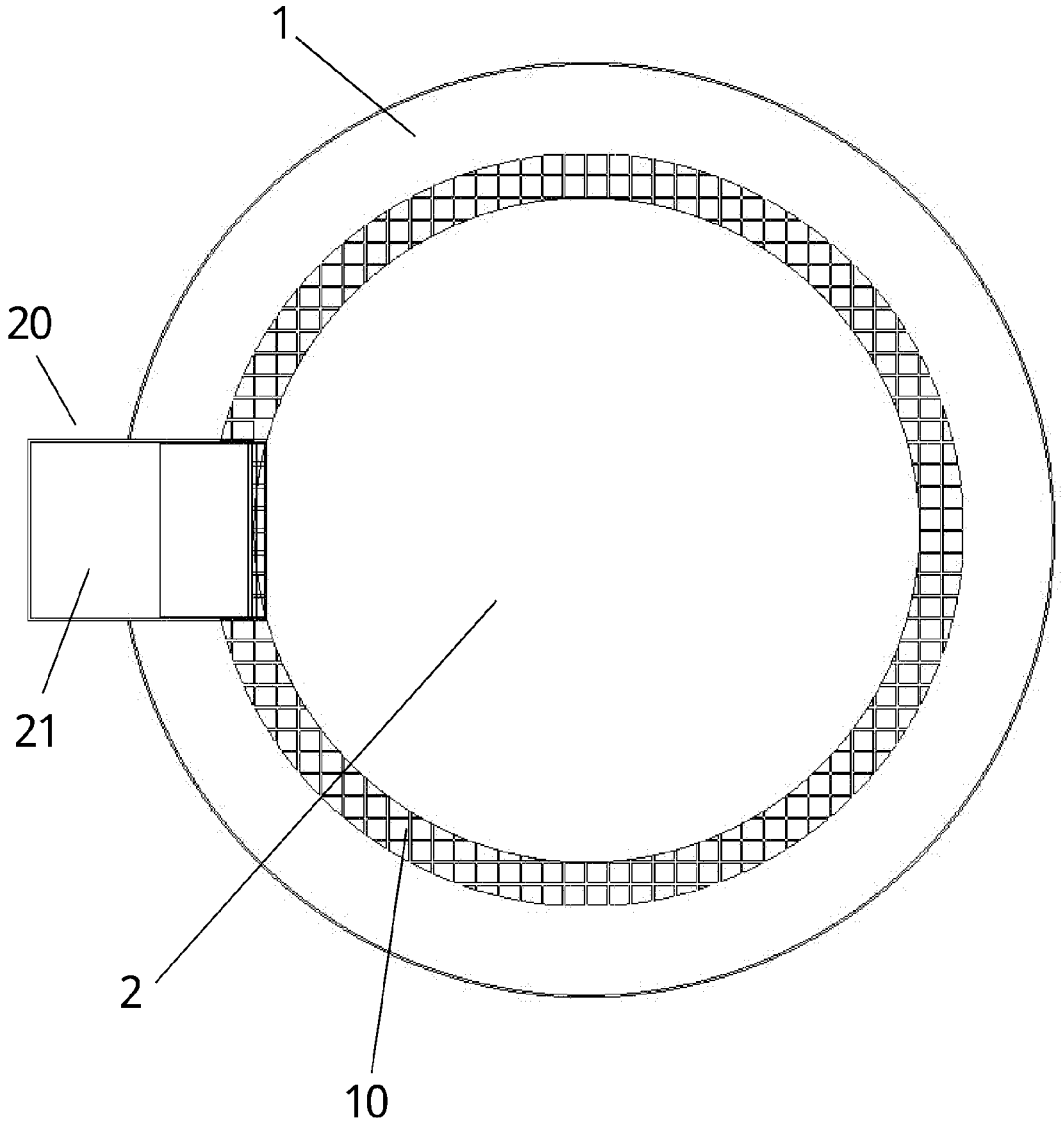
FIG. 7 illustrates cutaway of annular frame with sliders but without safety net.

A safety net (as seen in FIGS. 1, 2 and 6) for a vertical wind tunnel comprises an annular frame 1 arranged therearound a flight area 2 of vertical wind tunnel where a flight may be performed. The safety net further comprises a plurality of cables 3 forming a net area 4 over the flight area 2 and springs 5, wherein each end of plurality of cables 3 is attached to the annular frame 1 via springs 5.

Figure 3:
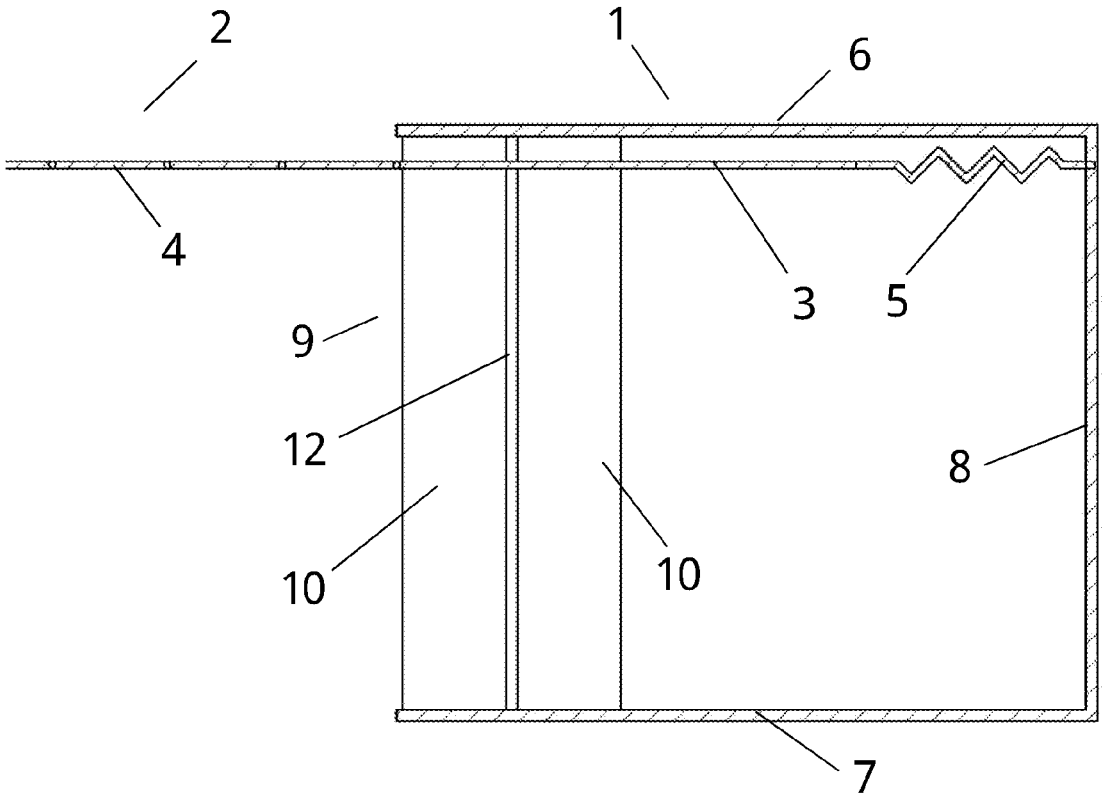
FIG. 3 illustrates a cross section of the annular frame 1 with a spring 5 and cables 3.

The annular frame 1 (as seen in FIG. 3) has an upper surface 6, a lower surface 7 and an outer surface 8 in form of plates that encloses the annular frame 1. An inner surface 9 is exposed to the flight area 2. The springs 5 and each end of plurality of cables 3 is enclosed by the annular frame 1 so that only cables 3 are exposed to the flight area 2 and a user of the safety net.

The safety net further comprises a slider 10 (as seen in FIGS. 2, 3, 5, 6 and 7) arranged in the annular frame 1 at the inner surface 9 thereof and substantially around the flight area 2. The the slider 10 extends from the upper surface 6 to the lower surface 7 of the annular frame 1. The slider 10 further comprises guide openings 11 extending from the upper surface 6 to the lower surface 7 of the annular frame 1 so that the cables 3 may extend through the guide openings 11 and can move along the guide openings 11 up and down without touching the annular frame 1 or any other member of the vertical wind tunnel, when a user of the vertical wind tunnel walks or falls on the net area 4.

Figure 5:
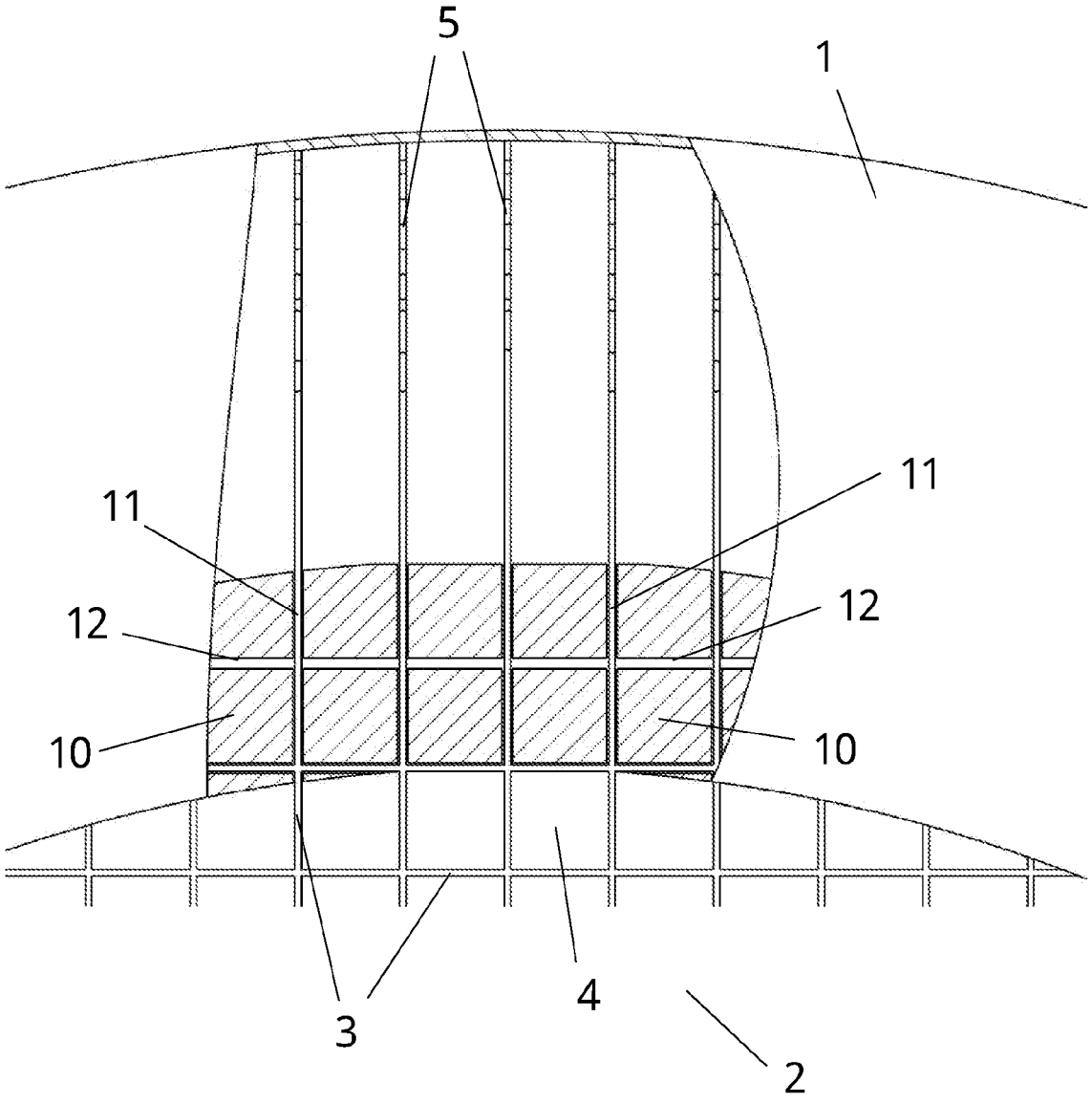
FIG. 5 illustrates section of the annular frame 1 in a view from above and with cut out in an upper surface of the annular frame 1 exposing a slider 10 with guide openings 11 and orthogonally positioned auxiliary guide openings 12.

The slider 10 further comprises auxiliary guide openings 12 (as seen in FIG. 5) positioned orthogonally to the guide openings 11 so that the cables 3 that are orthogonally positioned relative to other cables 3 may extend through the slider 10 and other cables 3 can move along the auxiliary guide openings 12 up and down, when a user of the vertical wind tunnel walks or falls on the net area 4.

The safety net further comprises an entrance unit 20 (as seen in FIGS. 1, 2, 4, 6 and 7) arranged in one segment of the annular frame 1. The entrance unit 20 defines an entrance in the flight area 2 of the vertical wind tunnel.

Figure 4:
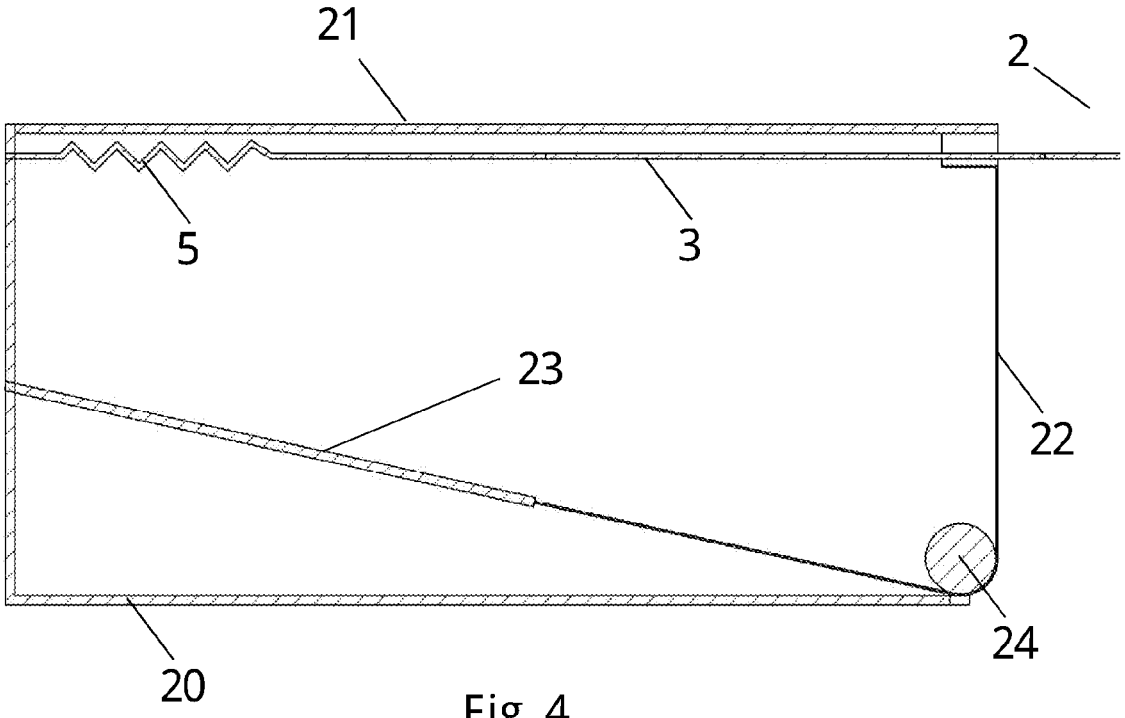
FIG. 4 illustrates a cross section of an entrance unit 20.

The entrance unit 20 (as seen in FIG. 4) further comprises an entry platform 21 positioned in the same level as the upper surface of the annular frame 1. A first end of the entry platform 21 is hingedly attached to the entrance unit 20 and a second end of the entry platform 21 is free and extends until the flight area 2. The entrance unit 20 further comprises a belt 22 attached to the second end of the entry platform 21 and the belt 22 covers the surface of the entrance unit 20 that is exposed to the flight area 2 or vertical wind tunnel where a vertical air flow is guided. The belt 22 further extends into the entrance unit 20 by bending around a roller 24 that is disposed in a lower part of the entrance unit 20. The entrance unit 20 further comprises a resilient member 23 with one end thereof attached to the belt 22 and with another end thereof attached to the entrance unit 20 so that the belt 22 is kept tensioned when the entry platform 21 is hingedly moved downwards, when a user of the vertical wind tunnel walks in or out from the flight area 2 via the entry platform 21.

Figure 8:
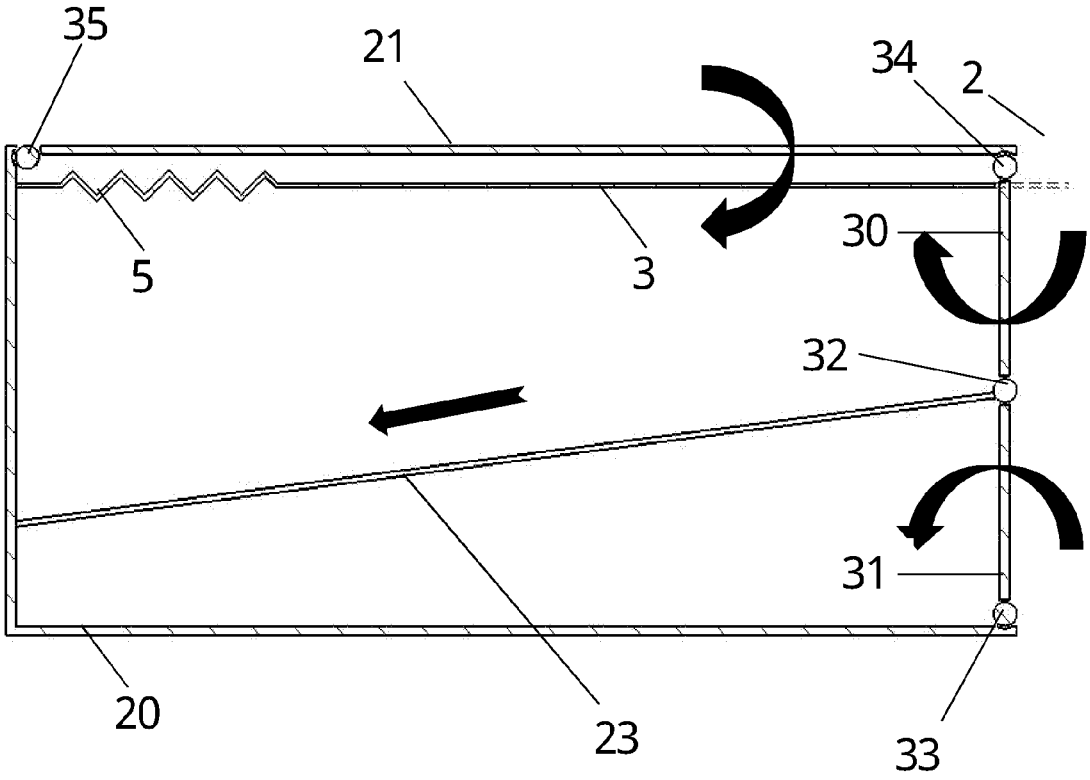
FIG. 8 illustrates a cross section of an entrance unit 20 of another embodiment.

In another embodiment (see FIG. 8) the entrance unit 20 comprises an entry platform 21 positioned in the same level as the upper surface of the annular frame 1. The first end of the entry platform 21 is hingedly attached to the entrance unit 20 by means of a hinge 35 and a second end of the entry platform 21 is free and extends up to the flight area 2. The entrance unit 20 instead of the belt 20, as described in aforementioned embodiment, comprises first plate 30 and a second plate 31 hingedly attached to each other by a hinge 32. The first plate 30 is hingedly attached to the second end of the entry platform 21 by means of an upper hinge 34 and the second plate 31 is attached lower surface of the entrance unit 20 or the annular frame 1 by means of a lower hinge 33. Both plates 30 and 31 cover the surface of the entrance unit 20 that is exposed to the flight area 2. The entrance unit 20 further comprises a resilient member 23 with one end thereof attached to the hinge 32 and with another end thereof attached to the entrance unit 20 or the annular frame 1 so that the plates 30 and 31 are folded when the entry platform 21 is hingedly moved downwards towards the lower surface of the annular frame 1, when a user of the vertical wind tunnel walks in or out from the flight area 2. For ease of understanding rotations of elements around their respective hinges a illustrated in FIG. 8 with bullets.

The invention has been described with reference to various specific and illustrative embodiments and techniques. However, one skilled in the art will recognize that many variations and modifications may be made while remaining within the scope of the invention as defined in the appended claims.

The invention claimed is:

1. A safety net for a vertical wind tunnel comprising:

an annular frame arranged therearound a flight area, wherein the annular frame has an upper surface, a lower surface, an outer surface and an inner surface wherein said outer and inner surfaces extend from said upper surface to said lower surface, such that the flight area is defined by said inner surface;

a plurality of cables forming a net area over the flight area, said plurality of cables extend from the outer surface on one side of said flight area to the outer surface of an opposite side of the said flight area such that said net area is defined by said outer surface, wherein each end of plurality of cables is attached to the outer surface of the annular frame via springs, wherein the springs and each end of plurality of cables is enclosed by the annular frame so that only cables are exposed to the flight area and a user of the safety net, a slider arranged at the inner surface of the annular frame, wherein the slider extends from the upper surface to the lower surface of the annular frame in perpendicular to said cables, the slider further comprises guide openings extending from the upper surface to the lower surface of the annular frame, said guide opening is configured to allow the cables to extend through the guide openings and to move up and down along the guide openings without touching the annular frame or any other member of the vertical wind tunnel, when a user of the vertical wind tunnel walks or falls on the net area.

2. The safety net according to claim 1, wherein the slider further comprises an auxiliary guide openings positioned orthogonally to the guide openings so that the cables that are orthogonally positioned relative to other cables may extend through the slider and other cables can move along the auxiliary guide openings up and down, when a user of the vertical wind tunnel walks or falls on the net area.

3. The safety net according to claim 1, wherein the safety net further comprises an entrance unit arranged in the annular frame where an entrance in the flight area of the vertical wind tunnel is positioned.

4. The safety net according to claim 3, wherein the entrance unit comprises:

an entry platform positioned in the same level as the upper surface of the annular frame, where a first end of the entry platform is hingedly attached to the entrance unit and a second end of the entry platform is free and extends until the flight area, a belt attached to the second end of the entry platform and covers the surface of the entrance unit that is exposed to the flight area;

a resilient member with one end thereof attached to the belt and with another end thereof attached to the entrance unit so that the belt is kept tensioned when the entry platform is hingedly moved, when a user of the vertical wind tunnel walks in or out from the flight area.

5. The safety net according to claim 3, wherein the entrance unit comprises:

an entry platform positioned in the same level as the upper surface of the annular frame, where a first end of the entry platform is hingedly attached to the entrance unit and a second end of the entry platform is free and extends up to the flight area, a first and a second plates hingedly attached to each other by the hinge and the first plate is hingedly attached to the second end of the entry platform and the second plate is attached to the lower surface of the entrance unit or the annular frame and both plates cover the surface of the entrance unit that is exposed to the flight area;

a resilient member with one end thereof attached to the hinge and with another end thereof attached to the entrance unit or the annular frame so that plates are folded when the entry platform is hingedly moved downwards towards the lower surface of the annular frame, when a user of the vertical wind tunnel walks in or out from the flight area.

* * * * *